United States Patent [19]

Hemmer

[11] 4,447,080

[45] May 8, 1984

[54] CHAIN SECURITY DEVICE

[76] Inventor: Clemens J. Hemmer, 352-G Carlyle East, Belleville, Ill. 62221

[21] Appl. No.: 123,924

[22] Filed: Mar. 31, 1980

[51] Int. Cl.[3] ..... E05C 17/36

[52] U.S. Cl. ..... 292/264

[58] Field of Search ..... 292/264; 411/910, 911

[56] References Cited

U.S. PATENT DOCUMENTS

| | | | |
|---|---|---|---|
| 1,243,799 | 10/1917 | Bissell | 411/910 X |
| 2,816,431 | 12/1957 | Harney | 292/264 X |
| 3,274,809 | 9/1966 | Kozlowski | 292/264 X |

FOREIGN PATENT DOCUMENTS

| | | | |
|---|---|---|---|
| 5784 | 6/1903 | Denmark | 292/264 |
| 121972 | 8/1901 | Fed. Rep. of Germany | 292/264 |
| 233637 | 5/1925 | United Kingdom | 292/264 |

*Primary Examiner*—Richard E. Moore

[57] ABSTRACT

A security locking device comprising two units, each unit comprising two chains secured to a plate by a U-shaped bar. The ends of the bar are set in holes in the plate and hammered flat; and a plurality of screws secure the plate to a wall or door. The heads of these screws are ground flush with the plate and spot-welded thereto. A padlock secures the ends of the chains.

1 Claim, 3 Drawing Figures

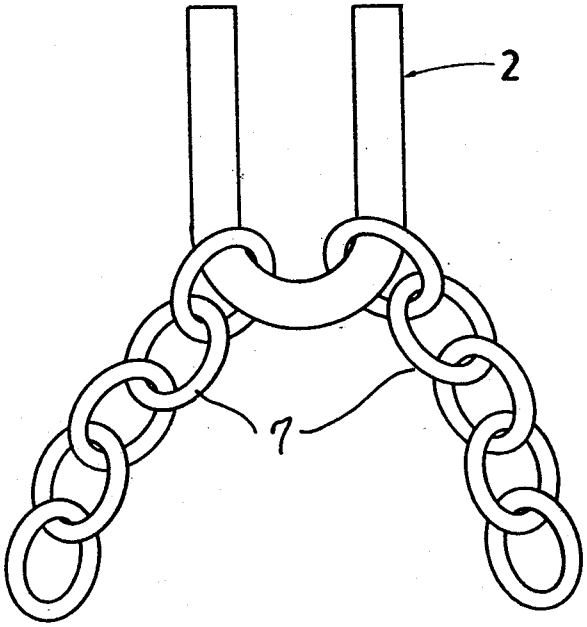
Fig. 3
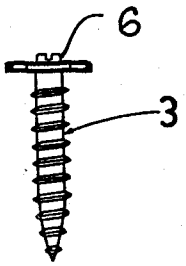
Fig. 2
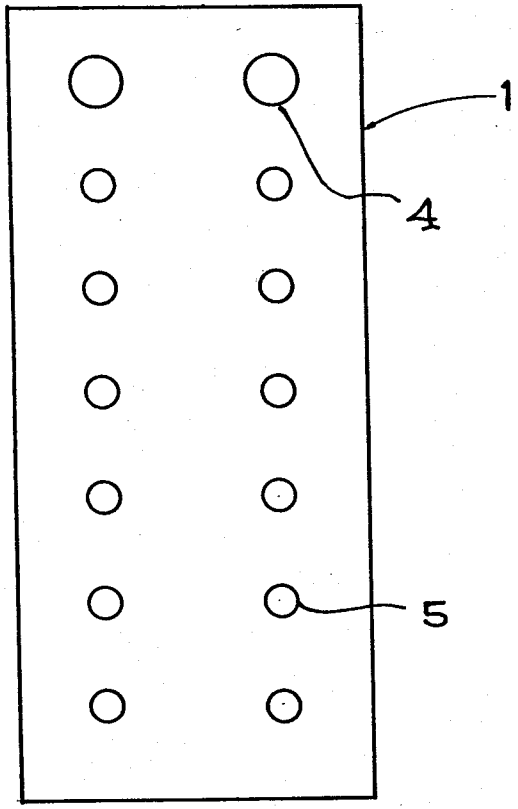

CHAIN SECURITY DEVICE

BRIEF DESCRIPTION OF THE DRAWINGS

FIG. 1 is a plan view of one of the two apertured plates.

FIG. 2 is a side view of one of the plurality of screws.

FIG. 3 is a side view of the U-shaped bar with two chains attached thereto.

DETAILED DESCRIPTION OF THE PREFERRED EMBODIMENT

A steel plate 7" long, 3" wide and ⅜" thick, (See No. 1). A U-bar of medium heavy chain material 1½" or 2" long, with the chains hooked onto same, (See No. 2), and 12 screws approximately 1½" long with a slotted cap at the top (See No. 3). The larger holes are drilled in the plate as shown on the drawing, (See No. 4). These holes are just large enough to receive the U-bar. The 12 holes (See No. 5), are drilled just large enough to receive the screws. The screws have a slotted cap (See No. 6). The drilled holes for the screws are to have a concave bevel to fit the convex bevel at the top of the screw. The U-bar is heated to a red heat prior to hooking of the chains on same. At this point the U-bar is inserted into the two drilled holes, (See No. 4). Then the plate is inverted and the ends of the U-bar are hammered out completely flat, thus holding the chains intact. At this point the plate is mounted on a wall or door by means of the screws. The screws are inserted into the drilled holes, (See No. 5) and are driven into the wall or door by means of a screw driver, which is inserted into the slot in the cap, (See No. 6). After all the screws are driven into the wall or door securely, the caps (See No. 6) are ground down flush with the steel plate. The next step is to put a spot weld on each screw, thus making it impossible to remove the plate from either the wall or door.

The second unit is assembled. Follow the same procedure as outlined above. Then the chains are to be connected by either combination locks or padlocks. A conventional key would open the lock on the door and allow the door to open sufficiently so that someone could get their hands inside to unlock the chains.

I claim:

1. A security locking device comprising a plate having a pair of relatively large holes which receive the ends of a U-bar, and series of relatively small holes which each receive a mounting screw securing the plate to a support; at least one chain having its end link secured around the U-bar; the ends of said U-bar closely fitted in said relatively large holes and swaged to attach it to the plate; the head of each screw being flush with and spot-welded to said plate, whereby the device may be used in pairs to be secured together, as by a padlock.

* * * * *